US005156406A

United States Patent [19]

Johnson et al.

[11] Patent Number: 5,156,406

[45] Date of Patent: Oct. 20, 1992

[54] BOARD GAME OF SPINNER ASSEMBLY DICE AND PIECES

[76] Inventors: Cordelia Johnson; Lawrence Johnson, both of 2413 Cuthbert Dr., Lindenwold, N.J. 08021

[21] Appl. No.: 581,361

[22] Filed: Sep. 12, 1990

[51] Int. Cl.[5] ..... A63F 3/00

[52] U.S. Cl. ..... 273/248

[58] Field of Search ..... 273/248, 249, 250, 253

[56] References Cited

U.S. PATENT DOCUMENTS

| | | | |
|---|---|---|---|
| 715,474 | 12/1902 | Gaylor | 273/248 |
| 1,536,672 | 5/1925 | Hobbs | 273/249 |
| 1,631,505 | 6/1927 | Samis | 273/249 |
| 2,780,463 | 2/1957 | Salomon | 273/249 |
| 3,414,264 | 12/1968 | Schriber | 273/248 |
| 4,002,341 | 1/1977 | Chin | 273/248 |
| 4,119,321 | 10/1978 | Creel | 273/248 |
| 4,124,213 | 11/1978 | Kaplowitz | 273/248 |
| 4,211,419 | 7/1980 | Larsen | 273/248 |

FOREIGN PATENT DOCUMENTS

| | | | |
|---|---|---|---|
| 43662 | 1/1931 | Denmark | 273/248 |
| 515816 | 12/1939 | United Kingdom | 273/248 |

OTHER PUBLICATIONS

"Wheel of Fortune", *Games* (Magazine), Nov. 1986, p. 30.

*Primary Examiner*—George J. Marlo
*Assistant Examiner*—William E. Stoll

[57] ABSTRACT

A board game apparatus including a playing board having a surface with a plurality of contiguous rows of spaces, a plurality of designated spaces for initial positioning of sets of game pieces as well as a plurality of distinguishable finishing zones. The game apparatus is adapted with a combination of chance devices (1) Spinner Assembly and Chips (2) Dice. Wherein, multiple game pieces are advanced on the playing surface by the spin of the wheel or response to dice to determine the number of spaces the player moves on the game board. The players may at their own option either spin the wheel or toss the dice in an effort to decide which player opens the game. To win one of the players must succeed in placing all of their game pieces in scoring positions avoiding the obstacle members on the game board.

1 Claim, 2 Drawing Sheets

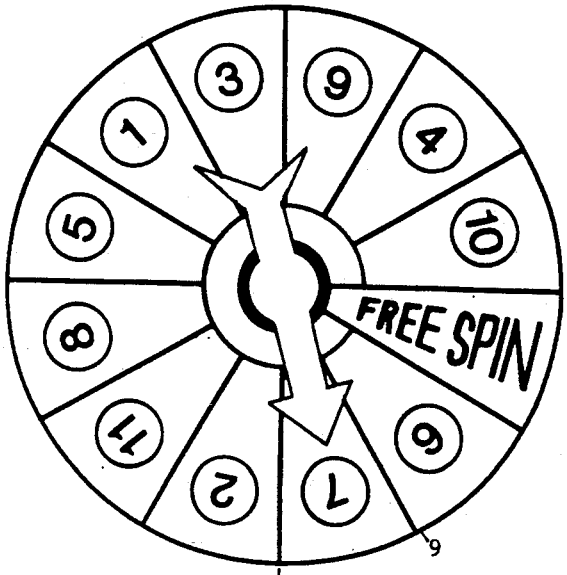
FIG. 2
FIG. 3
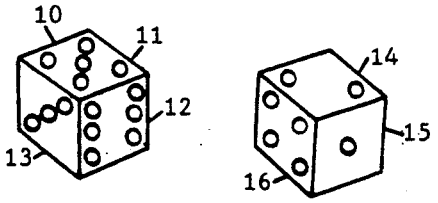
FIG. 4
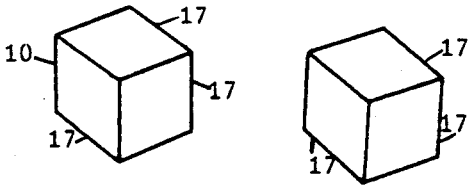
FIG. 5
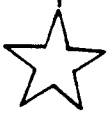
FIG. 6
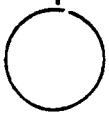
FIG. 7
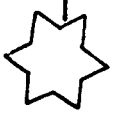
FIG.8
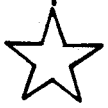

BOARD GAME OF SPINNER ASSEMBLY DICE AND PIECES

FIELD OF INVENTION

This invention relates to a game apparatus and more specifically a gameboard of multiple game pieces, Spinner Assembly, Dice, and Chips. Wherein, the boardgame is adapted with a combination of initiating devices and played in one of two different styles designed to stimulate and develop players sense of strategy to increase the challenge of the game.

BRIEF DESCRIPTION OF THE DRAWINGS

The objects and features of the invention may be understood with conjunction to the following detailed descriptions of the illustrations with the accompanying drawings wherein;

FIG. 2 is a perspective view of a Spinner Assembly used in the playing the game thereof of FIG. 1

FIG. 3 is a developed view of six different faces of two different "playing" dice which are used in the playing the game and;

FIG. 4 is a developed view of six different faces of two distinctively "3 sided blank" dice of opposite faces thereof of FIG. 3

FIG. 5 is a top view of the "moving" playing pieces of the boardgame thereof of FIG. 1

FIG. 6 is a perspective view of a "free chip" illustrating certain playing pieces used in playing the game thereof of FIGS. 1 and 2

FIG. 7 Illustrates a top view of a "Star Buster" obstacle members that are positioned on the playing surface board embodiment thereof of FIG. 1

FIG. 8 Illustrates a top view of a "Star" obstacle members that are positioned on the playing surface board embodiment thereof of FIG. 1

BACKGROUND AND PRIOR ART

Figure 1:
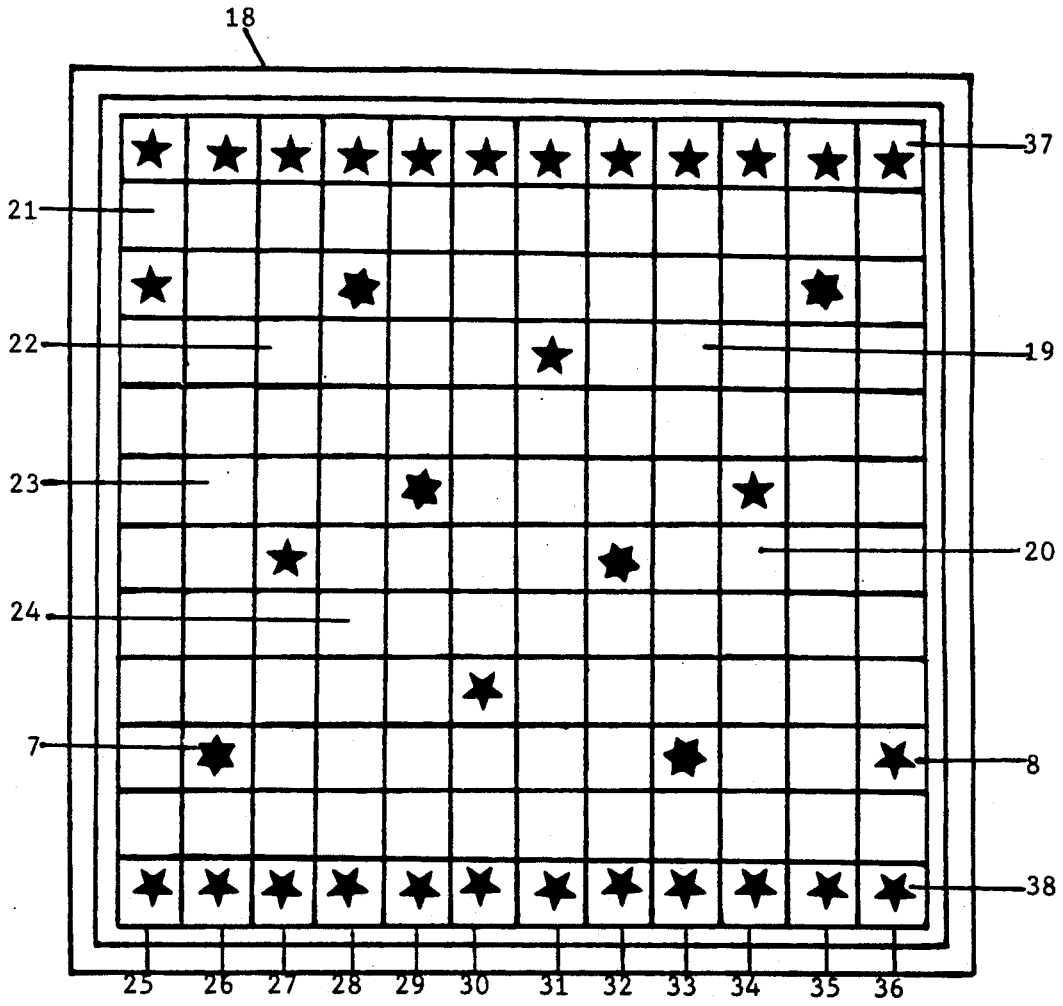
FIG. 1 is a perspective view of a gameboard according to the present invention showing a correspondingly matched starting zone situated diagonally across from a correspondingly matched finishing zone of the embodiment thereof

In reference to a number of games, there are many types of games played in various forms and specified manner and according to rules governing them. A large number of majority of them consist of nominal skill whereas, this particular invention is a game wherein, it is designed to stimulate and develop the players sense of strategy, skills and players judgement. The game also, can be played in a combination of one of two different styles in challenging the appeal of the game.

The prior art shows many of the aforementioned general types as described below:

U.S. Pat. No. 4,211,419 Entitled "GAME BOARD APPARATUS" describes a game conducted on a flat surface wherein, game having and arrangement of pairs of columns and point values are assigned within each group.

U.S. Pat. No. 4,002,341 Entitled "BOARD GAME OF HARE AND TORTOISE" describes a game conducted on a rectangular shaped playing surface wherein, the routes are not predetermined, but has an unlimited number of selective possibilities determined by the judgement of players. there are many other types of games of this general types as shown in: U.S. Pat. No. 3,414,264 to Schriber, U.S. Pat. No. 4,119,321 to Creel, and U.S. Pat. No. 4,124,213 to Kaplowitz et al. These aforementioned patents are non-applicable to my present invention.

SUMMARY OF INVENTION

The present invention relates to a unique and novel boardgame square in configuration which challenges the skills and strategy of the players. The uniqueness of the boardgame apparatus is that it is adapted with a combination of initiating devices. (1) Spinner Assembly and Chips are one form of chance device with numeral face and free spin face thereon; (2) Dice, another form of a chance device with faces bearing numeral indicia and the remaining faces having the same form thereof. Chips which are certain playing pieces used in conjunction with the spinner assembly which will later be detailed in the rules of play. The game apparatus can be played in one of two different styles, wherein, each initiating device is utilized singly in combination with the game apparatus in actuating the play on part of each player for more of a challenge. The game apparatus consisting of a playing surface, game pieces a multiplicity thereof, spinner assembly, dice and chips. Therefore, a toss of a die or spinner device are chance devices which are utilized by players in the employ of game apparatus for advancement of game pieces on playing surface thereon, whereas, players can choose from one to the other exclusion of there playing pieces for determining the number of different distances through which the chosen game pieces may be advanced. Skill and strategy is the main objective of playing the game, whereas players should exercise judgement in choosing the best strategy of play. The objective of the game is for one or the other player to win by moving all twelve of there "Star" playing pieces from there starting positions spaces to opponents finishing scoring positions spaces avoiding the "Star Busters" obstacle members on the gameboard.

The players are uniquely assigned game tracks each one of which is divided into a number of contiguous rows of spaces. Each player has a distinguishable set of game pieces of different colors, wherein, a plurality of starting zones to provide each player of the game with designated spaces for initial positioning of each set therein, and a plurality of distinguishable finishing zones to provide each of players with designated spaces for final positioning of each set therein, wherein, said spaces defining a path of movement for playing pieces in a horizontal direction.

There are a correspondingly matched starting zones situated diagonally across from a correspondingly matched finishing zones which are of distinctively two different colors for easily identifying each zone.

DETAILED DESCRIPTION OF THE DRAWINGS

Referring to the drawings, wherein, FIG. 1 shows a generally square configuration gameboard 18 as illustrated in the embodiment of FIG. 1 wherein, the game apparatus 18 is played by two players until one of the players is the winner of the game. The subject game apparatus is well adapted for numerous types of initiating chance devices, which include a combination of Spinner Assembly, Dice and Chips as illustrated in FIGS. 2, 10, and 6. These items are used singly to actuate play on part of each player. Specific illustrations will be detailed in later discussion.

The game apparatus comprises a gameboard 18 having a playing surface 24 on which distinguishable sets of playing pieces 5 are positioned and supported. The playing surface 24 having a plurality of contiguous rows 18 being illustrated extending longitudinally of the board 18 and each auxiliary playing track 22,23 containing a plurality of spaces or squares 21. In the embodiment of the playing surface 24 is divided into a 144 spaces 21. In effect the gameboard 18 is composed of twelve auxiliary playing tracks 25 through 36 inclusive, and each having an equal number of spaces 21 therein. The spaces defining a path of movement of sets 5 of playing pieces.

On the opposite sides of the main playing tracks there are two fixed effect scoring position areas designated 25 through 36 each comprising a plurality of scoring position spaces.

The main playing tracks 19 and 20 and the auxiliary playing tracks 22 and 23, have a plurality of twelve contiguous longitudinal rows and on each said row twelve squares upon the spaces are occupied between said opposing rows on the surface thereof.

At the outer end of each of the contiguous rows in each of the playing tracks there is a designated starting position for a game piece the game pieces all resembling stars in the illustrated example. These game pieces correspond with each row in where to which the game piece is placed from left to right consecutively at each end of the gameboard, whereas, players will sit facing each other. In the main playing tracks 19, 20 the starting spaces extend transversely across the board in alignment with the spaces bearing the reference numeral 38. These spaces in the drawings shown in FIG. 1 shows designated fixed effect spaces at starting and finishing zones labelled 25 through 36 inclusive.

The other end of the gameboard 18 the starting position spaces are transversely aligned with the space marked with the reference character 37 all of these spaces are likewise occupied with game pieces.

There is also provided a plurality of starting zones 25 to 36 on which respective sets of playing pieces may be positioned. Each of the starting zones are divided into two groups consisting of twelve starting spaces. In this manner each group has twelve designated starting spaces extending along side of the gameboard 18 since the object of the playing pieces is to cross the board, which will be described in the rules of play. There are correspondingly matched starting zones situated diagonally across from the correspondingly matched finishing zone.

Formed in the shape of a star configuration there are twenty-four game pieces divided into two distinguishable sets of game pieces positioned on the playing tracks. Each set therefore will be of separate color for each player to identify each of there movable playing pieces on opposing sides of gameboard 18. These two colors identified are for illustrative purposes, one set of game pieces being blue and the latter set white In effect, the scoring position spaces labelled 25 through 36 are diversely colored from each other as to readily distinguish each starting and finishing zone. As previously indicated earlier, the game apparatus is adaptable to a combination of numerous devices for play as indicated in FIGS. 2 and 3 will show two different types of chance devices for initiating play. Each device will be utilized singly in the employ of the game apparatus which will be operable by players of the game for determining the possible number of spaces a particular playing pieces shall move along the playing surface 24 for movement from one starting zone 25 to 36 to a corresponding finishing zone as detailed below in one of two different forms;

FIG. 2 shows a chance device Spinner Assembly with numeral bearing face numbered from 1–11 and a free spin space thereon, the spinner device is operable by players in order to determine which of the various game pieces can be moved, and how many spaces the player can advance there game playing pieces. Free chips are awarded if the player lands on the free spin space for bonus spins.

FIGS. 3 and 4 shows "playing" dice as illustrated numbered 1 through 6, wherein, FIG. 3 shows a set of die having three equally distributed numbered faces 1, 2, 4, on one die and 3, 5, 6, on latter die labelled 11, 12, 13, 14, 15, 16, FIG. 4 shows the opposite sides of FIG. 3 having three equally distributed blank-sided faces of the same form labelled number 17 respectively.

These "playing" dice shown in FIGS. 3 & 4 are used to determine which of the various game pieces can be moved by player and to determine how many spaces the player can advance there game playing pieces.

FIG. 5 shows "movable" playing pieces that are moved on the top playing surface formed in the shape of a star.

FIG. 6 shows "free chip" a certain playing piece whereas, the game pieces are used in conjunction with the spinning device.

FIG. 7 shows "star Buster" a plurality of obstacle members that are positioned on the top playing surface and each obstacle member occupies six playing squares on the gameboard.

FIG. 8 shows "star" a plurality of obstacle members that are positioned on the top of playing surface and each obstacle member occupies six playing squares on the gameboard.

RULES OF PLAY

The game is played by two players described are various instructions and aspects to the present invention detailed in two different forms of play in conjunction with specific instructions to provide players with the guidance in playing the game. First, described below in the rules of play is the Dice Instructions and following Spinner Assembly and Chips as set forth:

Dice Instructions

At the beginning of the game 18 players receives a distinguishable set of twelve "Star" playing pieces 5 wherein, the players selectively positions each playing piece 5 on the initial designated starting positions spaces 25 through 36. Each player is given a set of dice 10 with three numbered faces and three blank-sided faces on each set. The players then toss the dice and roll them and count the total number of points turning up on the dice 10 the person having the highest number of points is the winner of the move and from this roll the player selects which game piece 5 to move and how far to move it. Assuming an example, if player throws a number (4) on one face of die 10, and a blank side on the opposite face of die 10, then the player can move there playing piece 5 (4) spaces on the board 18 from any of the assigned auxiliary track rows 22, 23 on the gameboard 18. On the other hand, if the player throws the die 10 and both dice 10 turns up "Blank" the player would not advance a playing piece on the board 18. It is the object of the game for one or the other player to win by moving all twelve of there (12) "Star" playing pieces 5 from there starting positions spaces to opponents scoring positions 25 to 36 avoiding the "Star Buster" obstacle members 7 on the gameboard. As the game proceeds, the players takes turns rolling the dice 10 to determine the number of moves the player advances there playing piece 5 corresponding to the roll of die 10. The player can elect to move any one of there chosen game playing pieces 5 into the main playing tracks 19, 20 from any of the auxiliary track rows 22, 23 throughout the game 18 in a horizontal direction towards the designated scoring positions the player is attending to reach.

The auxiliary playing tracks 22,23 have only one scoring position space in each row for both players the space is therefore shared, and can be occupied by two players simultaneously. Therefore, the player can move a playing piece into the scoring position space if the opponent already has his piece in that same scoring position.

A player cannot move a playing piece 5 sideways, nor to left or right, backwards, jump a block or blocks in any circumstance, the only exception occurs if the player lands on the "Star" obstacle members 8 then the player immediately advances there game playing piece 5 to the scoring position space 25–36 on that same auxiliary track row 22, 23 of opponents scoring position space. If the player lands on the "Star Buster" obstacle members 7 then the player automatically returns there game playing piece 5 back to the original starting position space 25–36 on that same auxiliary track row 22, 23.

If a player throws a number on the dice 10 and doesn't have the required number of spaces to move his playing piece on the auxiliary track rows 22,23 then the player loses there turn, so forth.

SPINNER ASSEMBLY AND Chips INSTRUCTIONS

At the beginning of the game each player receives a distinguishable set of twelve "star" playing pieces 5 wherein, the players selectively positions each playing piece 5 on the initial designated starting positions spaces 25 through 36. The spinning device is spun by each player and the person having the highest number to which the pointer stops is the winner of the move and from this spin the player selects which game piece 5 to move and how far to move it. Assuming an example, if a player spins stops on the number 4, then the player moves there playing piece 5 4 spaces on the board 18 from any of the assigned auxiliary tracks 22, 23 on the gameboard 18. On the other hand, if a player stops on the "free spin space" the player is awarded a free chip for a Bonus spin the player has the option then to use his bonus spin now or later ( discretion is up to players) for additional spins as long it is that players turn to spin the wheel. The advantages of the Bonus spins is to block the freedom of movement of opponent playing piece in order to aid the player in winning the game earlier It is the object of the game for one or the other player to win by moving all twelve of there (12) star playing pieces 5 from there starting positions spaces 25 to 36 avoiding the "Star Busters" obstacle members 7 on the gameboard 18. As the game proceeds, the player takes turns spinning the wheel 9 to determine the number of moves a player advances his playing piece 5 corresponding to the number the pointer stops on the wheel 9 the player can then elect to move any one of the chosen game playing pieces 5 into the main playing tracks 19,20 from any of the auxiliary track rows 22,23 throughout the game 18 in a horizontal direction towards the designated scoring positions the player is attending to reach. The auxiliary playing tracks have only one scoring position space in each row for both players, the space is therefore shared, and can be occupied by two players simultaneously. Therefore, the player can move a playing piece into the scoring position space if the opponent already has his piece 5 in that same scoring position.

A player cannot move a playing piece 5 sideways, nor to left or right, backwards, jump a block, or blocks in any circumstance, the only exception occurs if the player lands on the "Star" obstacle members 8 then the player immediately advances there game playing piece 5 to the scoring position space 25–36 on that same auxiliary track row of opponents scoring position space. If the player lands on the "Star Buster" obstacle 7, then the player automatically returns there game playing piece 5 back to the original starting position space 25–36 on that same auxiliary track row 22, 23.

If a player spins a number on the spinning wheel and doesn't have the required number of spaces to move his playing piece 5 on the auxiliary track rows 22, 23 then the player loses there turn, so forth.

Herein of the illustrative embodiment of the present invention has been described in detail within reference to the accompanying drawings it is to be understood that the invention is not to be limited to the precise embodiment and that various changes and modifications may be effected without changing the scope of the invention.

I claim:

1. A board game apparatus which can be played using a spinner assembly or dice comprising:

a square game board having printed thereon 144 square 6 starts with 5 points each printed on the squares in the second through the eleventh rows to indicate a fist type of obstacle, 6 starts with 6 points each printed on the squares in the second through eleventh rows to indicate a second type of obstacle wherein only one obstacle is positioned in each column, the columns forming an array of playing tracks with the squares of the first and twelfth rows being starting; finishing squares, each column of squares defining a path of movement from end to end, printed indicia in each square of the first and twelfth rows to pg,23 indicate each square as a starting/finishing square;

twenty four movable player pieces divided into two groups of twelve each, each group being distinguishable by color, each player piece being formed in the shape of a star;

at least two six sided dice, each die comprising indicia on three faces in the form of a numerical representation for determining the movement of the player pieces, the remaining three faces of each die being blank;

a spinner assembly comprising a rotatable pointer mounted on a base, said base being printed with numbers ranging from one to eleven and having an area indicating a free spin; and chips for use with the spinner during play.

* * * * *

UNITED STATES PATENT AND TRADEMARK OFFICE

CERTIFICATE OF CORRECTION

PATENT NO. : 5,156,406

DATED : October 20, 1992

INVENTOR(S) : Cordelia & Lawrence Johnson

It is certified that error appears in the above-indentified patent and that said Letters Patent is hereby corrected as shown below:

Col. 6, line 37, should read --a square game board having printed thereon 144 square spaces in 12 contiguous rows and 12 contiguous columns, 6 stars--

Col. 6, line 40, should read --a first type of obstacle, 6 stars with 6 points--

Col. 6, line 49, delete --pg. 23--

Signed and Sealed this

Sixteenth Day of November, 1993

*Attest:*

*Attesting Officer*

Bruce Lehman

BRUCE LEHMAN

*Commissioner of Patents and Trademarks*